US012735760B2

(12) United States Patent
Qu et al.

(10) Patent No.: US 12,735,760 B2
(45) Date of Patent: Sep. 15, 2026

(54) PLASTIC MOLD STEEL PLATE AND METHOD FOR PRODUCING SAME

(71) Applicants: INSTITUTE OF RESEARCH OF IRON AND STEEL, JIANGSU PROVINCE/SHA-STEEL, CO. LTD (CN), Zhangjiagang (CN); Jiangsu Shagang Steel Co., Ltd., Zhangjiagang City (CN); JIANGSU SHAGANG GROUP CO., LTD., Zhangjiagang City (CN)

(72) Inventors: Jinbo Qu, Zhangjiagang City (CN); Fan Zhen, Zhangjiagang City (CN); Chunjuan Shao, Zhangjiagang City (CN); Hao Yang, Zhangjiagang City (CN)

(73) Assignees: INSTITUTE OF RESEARCH OF IRON AND STEEL, JIANAGSU PROVINCE/SHA-STEEL, CO., LTD. (CN), Suzhou (CN); JIANGSU SHAGANG STEEL CO., LTD., Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 430 days.

(21) Appl. No.: 18/575,724

(22) PCT Filed: Aug. 4, 2021

(86) PCT No.: PCT/CN2021/110563
§ 371 (c)(1),
(2) Date: Dec. 29, 2023

(87) PCT Pub. No.: WO2023/272873
PCT Pub. Date: Jan. 5, 2023

(65) Prior Publication Data

US 2024/0336988 A1 Oct. 10, 2024

(30) Foreign Application Priority Data

Jun. 30, 2021 (CN) ..... 202110737282.3

(51) Int. Cl.
*C21D 8/0247* (2026.01)
*C21D 1/28* (2006.01)
(Continued)

(52) U.S. Cl.
CPC ..... *C21D 8/0263* (2013.01); *C21D 1/28* (2013.01); *C21D 8/0226* (2013.01); *C21D 9/46* (2013.01);
(Continued)

(58) Field of Classification Search
None
See application file for complete search history.

(56) References Cited

FOREIGN PATENT DOCUMENTS

CN 102002638 A 4/2011
CN 102330020 B * 5/2013
(Continued)

OTHER PUBLICATIONS

English language machine translation of CN-111809114-A. Generated Apr. 23, 2026. (Year: 2026).*
(Continued)

*Primary Examiner* — Brian D Walck
(74) *Attorney, Agent, or Firm* — MUNCY, GEISSLER, OLDS & LOWE, P.C.

(57) ABSTRACT

A plastic mold steel plate and a method for producing the same. The method includes: heating a billet, the temperature of a soaking section being 1210~1250° C.; rolling into a steel plate, an initial rolling temperature being 1060~1140° C., and a final rolling temperature being 980~1050° C.; moving the steel plate to a cooling bed for air cooling to 200° C. or lower; then normalizing, a normalizing tempera-
(Continued)

ture being $A_{c3}$+60° C. to $A_{c3}$+90° C.; after normalizing, moving the steel plate to the cooling bed for air cooling to $B_f$−50° C. to $B_f$−20° C.; finally, cross-stacking the steel plate with a ferritic pearlitic steel plate with a temperature of 450~550° C.; during the stacking period, self-tempering the steel plate until the temperature of the steel plate is reduced to $B_f$−50° C. to $B_f$−20° C.; and after that, unstacking and air cooling.

14 Claims, 4 Drawing Sheets

(51) Int. Cl.

| | |
|---|---|
| ***C21D 8/0221*** | (2026.01) |
| ***C21D 9/46*** | (2006.01) |
| ***C22C 38/02*** | (2006.01) |
| ***C22C 38/04*** | (2006.01) |
| ***C22C 38/44*** | (2006.01) |

(52) U.S. Cl.
CPC ..... *C22C 38/02* (2013.01); *C22C 38/04* (2013.01); *C22C 38/44* (2013.01); *C21D 2211/005* (2013.01); *C21D 2211/009* (2013.01)

(56) References Cited

FOREIGN PATENT DOCUMENTS

| | | | | | |
|---|---|---|---|---|---|
| CN | 105755238 | A | * | 7/2016 | ..... C21D 8/02 |
| CN | 107587075 | A | | 1/2018 | |
| CN | 108441780 | A | | 8/2018 | |
| CN | 108866444 | A | | 11/2018 | |
| CN | 109504847 | A | | 3/2019 | |
| CN | 109957729 | A | * | 7/2019 | ..... C22C 38/48 |
| CN | 110527922 | A | | 12/2019 | |
| CN | 111321337 | A | * | 6/2020 | ..... C21D 8/02 |
| CN | 111809114 | A | * | 10/2020 | ..... C22C 38/002 |
| CN | 111826589 | A | | 10/2020 | |
| EP | 4130316 | A1 | * | 2/2023 | ..... C21D 8/02 |
| JP | 1990015117 | A | | 1/1990 | |
| JP | 1990294450 | A | | 12/1990 | |
| JP | 2000160280 | A | | 6/2000 | |
| KR | 100960088 | B1 | | 5/2010 | |

OTHER PUBLICATIONS

English language machine translation of CN-109957729-A. Generated Apr. 23, 2026. (Year: 2026).*
English language machine translation of CN-105755238-A. Generated Apr. 23, 2026. (Year: 2026).*
English language machine translation of CN-102330020-B. Generated Apr. 23, 2026. (Year: 2026).*

* cited by examiner

PLASTIC MOLD STEEL PLATE AND METHOD FOR PRODUCING SAME

TECHNICAL FIELD

The present invention belongs to the technical field of material preparation, and relates to a method for producing a plastic mold steel plate, and a plastic mold steel plate prepared by the method.

BACKGROUND

With the rapid development of the petrochemical process, the volume of production of plastics has increased rapidly. A large number of plastic products need to be molded by mold compression in the production process, and the mold materials are the key factor affecting the quality, property and service life of the molds.

Plastic mold materials are mainly mold steel, and mold steel is mainly processed into various mold base parts such as gating systems, cavities, and cores. Due to the complex structure, the plastic material is in contact with the inner cavity surface of the mold base, which is prone to wear and impact, etc. Therefore, it is required that the cross-section structure and mechanical properties of the mold steel plate are uniform and the mold steel plate is not deformed during processing. However, for the existing plastic mold steel plate, long-process, high-cost production methods are adopted to improve the uniformity, for example, mold casting, forging, quenching and other processes. Alternatively, the structure uniformity of the surface and core of the existing plastic mold steel plate is very poor. The cross-section Rockwell hardness difference is 4 HRC or more.

SUMMARY

In order to solve the above technical problems, the objective of the present invention is to provide a plastic mold steel plate and a method for producing the same, using a short process route, while improving the structure uniformity.

In order to achieve the above objective of the present invention, one implementation of the present invention provides a method for producing a plastic mold steel plate, which includes the following processes:

first heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

second heating: reheating the billet discharged from the furnace in the first heating process, a temperature of a soaking section being 1140~1170° C., and an in-furnace time being ≥200 min;

rolling: rolling the billet discharged from the furnace in the second heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}+60°$ C.$\leq T_N \leq A_{c3}+90°$ C.;

cooling after normalizing: moving the steel plate produced by the normalizing process to the cooling bed for air cooling to $T_F$, $B_f-50°$ C.$\leq T_F \leq B_f-20°$ C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $T_F$, $B_f-50°$ C.$\leq T_M \leq B_f-20°$ C.; after that, unstacking and naturally air cooling the steel plate to room temperature, where the cross stacking is that bottom and top layers are ferritic pearlitic steel plates, and steel plates and ferritic pearlitic steel plates are alternately stacked layer by layer.

Further preferably, a length $L_2$, a width $W_2$, and a thickness $H_2$ of the steel plate and a length $L_1$, a width $W_1$, and a thickness $H_1$ of the ferritic pearlitic steel plate meet: $L_1 \geq L_2+500$ mm, $W_1 \geq W_2+300$ mm, and $H_1 \geq H_2$.

Further preferably, in the second heating process, the billet is subjected to the three-stage heating, an input temperature is ≥700° C., the temperature of the preheating section is 950~1000° C., and the temperature of the heating section is 1100~1150° C.

Further preferably, in the rolling process, the billet is rolled into a steel plate with a thickness of ≥80 mm.

Further preferably, any one or both of the cooling after rolling process and the cooling after normalizing process includes/include:

first, moving the steel plate to the cooling bed for naturally air cooling the steel plate until an upper surface temperature of the steel plate is reduced to $T_A$, $B_s+15°$ C.$\leq T_A \leq B_s+35°$ C.;

then, turning a fan on and disturbing air under the steel plate through the fan to control a difference between the upper surface temperature and a lower surface temperature of the steel plate ≤5° C. until the upper surface temperature of the steel plate is reduced to $T_F$.

Further preferably, the blowing direction of the fan is parallel to a lower surface of the steel plate or diagonally down away from the lower surface of the steel plate.

Further preferably, unevenness of the obtained steel plate is ≤4 mm/2 m.

Further preferably, a final cooling temperature is 100~200° C. in the cooling after rolling process; and an input temperature in the normalizing process is ≥100° C.

Further preferably, a difference in Rockwell hardness of a surface layer and a core of the obtained steel plate is ≤1.6 HRC.

Further preferably, the chemical composition of the billet used includes: C 0.33~0.38%, Si 0.11~0.19%, Mn 0.70~0.90%, P≤0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0%~3.8%.

Further preferably, the obtained steel plate has a yield strength of ≥700 MPa, a tensile strength of ≥1050 MPa, a V-type Charpy impact of ≥15 J, and a Rockwell hardness of 31~34 HRC.

In order to achieve the above objective of the invention, one implementation of the present invention provides a plastic mold steel plate. A method for producing the plastic mold steel plate includes the following processes:

first heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

second heating: reheating the billet discharged from the furnace in the first heating process, a temperature of a soaking section being 1140~1170° C., and an in-furnace time being ≥200 min;

rolling: rolling the billet discharged from the furnace in the second heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}+60°$ C.$\leq T_N \leq A_{c3}+90°$ C.;

cooling after normalizing: moving the steel plate produced by the normalizing process to the cooling bed for air cooling to $T_F$, $B_f-50°$ C.$\leq T_F \leq B_f-20°$ C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $B_f-50°$ C.$\leq T_M \leq B_f-20°$ C.; after that, unstacking and naturally air cooling the steel plate to room temperature, where the cross stacking is that bottom and top layers are ferritic pearlitic steel plates, and steel plates and ferritic pearlitic steel plates are alternately stacked layer by layer.

In order to achieve the above objective of the present invention, one implementation of the present invention provides a method for producing a plastic mold steel plate, which includes the following processes:

heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

rolling: rolling the billet discharged from the furnace in the heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}+60°$ C.$\leq T_N \leq A_{c3}+90°$ C.;

cooling after normalizing: moving the steel plate produced by the normalizing process to the cooling bed for air cooling to $T_F$, $B_f-50°$ C.$\leq T_F \leq B_f-20°$ C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $B_f-50°$ C.$\leq T_M \leq B_f-20°$ C.; after that, unstacking and naturally air cooling, where the cross stacking is that bottom and top layers are ferritic pearlitic steel plates, and steel plates and ferritic pearlitic steel plates are alternately stacked layer by layer.

Further preferably, a length $L_2$, a width $W_2$, and a thickness $H_2$ of the steel plate and a length $L_1$, a width $W_1$, and a thickness $H_1$ of the ferritic pearlitic steel plate meet: $L_1 \geq L_2+500$ mm, $W_1 \geq W_2+300$ mm, and $H_1 \geq H_2$.

Further preferably, any one or both of the cooling after rolling process and the cooling after normalizing process includes/include:

first, moving the steel plate to the cooling bed for naturally air cooling the steel plate until an upper surface temperature of the steel plate is reduced to $T_A$, $B_s+15°$ C.$\leq T_A \leq B_s+35°$ C.;

then, turning a fan on and disturbing air under the steel plate through the fan to control a difference between the upper surface temperature and a lower surface temperature of the steel plate ≤5° C. until the upper surface temperature of the steel plate is reduced to $T_F$.

Further preferably, the blowing direction of the fan is parallel to a lower surface of the steel plate or diagonally down away from the lower surface of the steel plate.

Further preferably, the chemical composition of the billet used includes: C 0.33~0.38%, Si 0.11~0.19%, Mn 0.70~0.90%, P≤0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0%~3.8%.

Further preferably, the obtained steel plate has a yield strength of ≥700 MPa, a tensile strength of ≥1050 MPa, a V-type Charpy impact of ≥15 J, and a Rockwell hardness of 31~34 HRC, and a difference in Rockwell hardness between a surface layer and a core is ≤1.6 HRC.

In order to achieve the above objective of the invention, one implementation of the present invention provides a plastic mold steel plate. A method for producing the plastic mold steel plate includes the following processes:

heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

rolling: rolling the billet discharged from the furnace in the heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}+60°$ C.$\leq T_N \leq A_{c3}+90°$ C.;

cooling after normalizing: moving the steel plate produced by the normalizing process to the cooling bed for air cooling to $T_F$, $B_f-50°$ C.$\leq T_F \leq B_f-20°$ C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $B_f-50°$ C.$\leq T_M \leq B_f-20°$ C.; after that, unstacking and naturally air cooling, where the cross stacking is that bottom and top layers are ferritic pearlitic steel plates, and steel plates and ferritic pearlitic steel plates are alternately stacked layer by layer.

Compared with the prior art, the invention has the following beneficial effects: through the process of heating, controlled rolling and cross-stacking self-tempering, the structure uniformity is significantly improved under a simple process route, and the difference in Rockwell hardness between the core and surface of the steel plate is within 1.6 HRC. The whole production process has a simple process flow; a short production cycle, high efficiency and low cost.

BRIEF DESCRIPTION OF THE DRAWINGS

FIG. 1*a* is a ¼ position of the cross section of the steel plate, and FIG. 1*b* is a ½ position of the cross section of the steel plate;

FIG. 2*a* is a ¼ position of the cross section of the steel plate, and FIG. 2*b* is a ½ position of the cross section of the steel plate;

FIG. 3*a* is a ¼ position of the cross section of the steel plate, and FIG. 3*b* is a ½ position of the cross section of the steel plate; FIG. 4*a* is a ¼ position of the cross section of the steel plate, and FIG. 4*b* is a ½ position of the cross section of the steel plate.

DETAILED DESCRIPTION

Figure 1A:
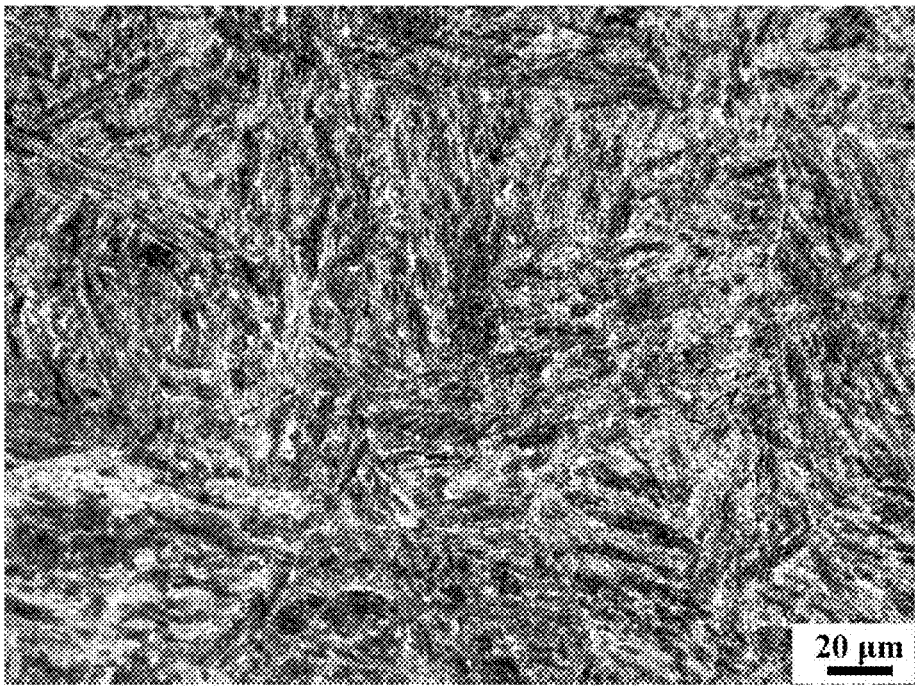
FIGS. 1*a* and 1*b* are a metallographic microstructure image of a cross section of a steel plate in Embodiment 1 of the present invention, where

As mentioned in the background, in the production of existing plastic mold steel plates, long-process, high-cost production methods are adopted to improve uniformity, for example, mold casting, forging, quenching and other processes. Alternatively, the structure uniformity of surface and core of the existing plastic mold steel plates is very poor. The cross-section Rockwell hardness difference is 4 HRC or above. That is, it is impossible to balance the two aspects of the production efficiency and cost as well as structure uniformity. For this reason, the present invention aims to provide a method for producing a plastic mold steel plate to break through the existing long process route including the processes such as die casting, forging, and quenching, however, a short process route is adopted to improve the structure uniformity.

The following is a further introduction to the technical solution of the present invention in conjunction with specific implementations, but the scope of protection required is not limited to the description.

First Implementation

The present implementation provides a plastic mold steel plate. The chemical composition of the plastic mold steel plate includes: C 0.33~0.38%, Si 0.11~0.19%, Mn 0.70~0.90%, P<0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0%~3.8%.

The role of each element in the chemical composition of the steel plate in the invention is briefly introduced below.

C: Intensifying element. However, the increase of C easily causes a decrease in plasticity and toughness. In the present invention, the mass percentage of C is controlled to 0.33~0.38%, which can achieve good strength and toughness matching.

Si: Deoxidizing element. However, the increase of Si will form iron olivine on the surface of a continuous casting billet, which affects the surface quality of the steel plate. In the present invention, the mass percentage of Si is controlled to 0.11~0.19%.

Mn, Cr, Ni, Mo: Mn and Cr can delay pearlite transformation. Cr increases a pearlite transformation temperature range. Mn reduces the pearlite transformation temperature range and easily leads to central segregation. In the present invention, the Cr/Mn ratio is controlled to 2 ±0.05, which can promote the core of the steel plate not to undergo pearlite transformation at a slow cooling speed. Mo can delay pearlite transformation, and increase the pearlite transformation temperature range. Ni can reduce austenite chemical free energy, and delay bainitic transformation. In the present invention, the Cr/(Mn+Ni) ratio is controlled to 1±0.05. Furthermore, in combination with the joint action of Mn, Cr, Ni and Mo, the transformation of ferrite and pearlite is strongly inhibited, and the bainitic transformation of the steel plate is realized in a wide range of cold speeds, from the surface to the core, and the uniform structure of the whole thickness is obtained.

P and S: Impurity elements. In this invention, the mass percentage of P is controlled to 0.014% or lower, preferably 0.008~0.014%: and the mass percentage of S is controlled to 0.004% or lower, preferably 0.002~0.004%.

Compared with the prior art, through the optimization design of the above chemical composition of the steel plate of the present invention, especially the interaction of C, Si, Mn, Cr, Ni, and Mo alloying elements, on this basis, bainitic transformation can occur in a wide range of cold speeds in the production process of the steel plate. In this way, the steel plate, especially the large thick plate with a thickness of ≥80 mm, can form a uniform structure even if there is a large difference in cold speed between the surface layer and the core, ensuring the uniformity of the structure. In addition, it is conducive to improving the structure uniformity of the steel plate under the loose process and large process window.

Further, through the optimization design of the above chemical composition, the present invention can also omit the precipitated elements such as Nb, V, and Ti, and high hardenability element B in the traditional technology, which not only saves the cost of the alloy, but also solves the crack defects caused by these elements. For example, the addition of Ti elements in the prior art easily forms TiN hard particles that generate crack sources. The addition of element B easily forms cracks during flame cutting of the mold steel plate due to the clustering of B in the grain boundary.

Further, in the implementation, the steel plate has a yield strength of ≥700 MPa, a tensile strength of ≥1050 MPa, a V-type Charpy impact of ≥15 J, and a Rockwell hardness of 31~34 HRC. The difference in Rockwell hardness between the surface layer and the core is ≤1.6 HRC. The steel plate has excellent mechanical properties, good hardness and uniform structure.

In the present implementation, the steel plate is prepared successively through the heating process, the rolling process, the cooling after rolling process, the normalizing process, the cooling after normalizing process, and the cross-stacking self-tempering process by using the billet. That is, the method for producing a steel plate includes the heating process, the rolling process, the cooling after rolling process, the normalizing process, the cooling after normalizing process, and the cross-stacking self-tempering process successively. Each of the processes is introduced in detail below.

(1) Heating Process

The billet is sent to the heating furnace for three-stage heating. That is, heating is carried out in the order of a preheating section, a heating section and a soaking section. The temperature of the preheating section is 850~950° C. The residence time of the preheating section is ≥60 min. The temperature of the heating section is 1100~1220° C. The temperature of the soaking section is 1210~1250° C. An in-furnace time is ≥240 min.

In this way, on the one hand, the heating speed of the billet is controlled to achieve the slow and uniform heating of the billet to ensure the surface quality of the billet and avoid microcracks. On the other hand, the high temperature insulation of the soaking section promotes the complete solid solution of the alloying elements in the billet, eliminates the columnar crystal structure in the billet, and ameliorates the core segregation defect.

As for the billet, a continuous casting billet is preferably adopted, but it is not limited to this. It is understandable that the chemical composition of the billet is the same as that of the steel plate. The chemical composition of the billet also includes: C 0.33~0.38%, Si 0.11~0.19%. Mn 0.70~0.90%, P≤0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0%~3.8%. The chemical composition of the billet is not limited to this, and may be modified and embodied into other chemical compositions suitable for the method of the present invention.

Further preferably: the heating process may alternatively be as follows: the above three-stage heating is used as the first heating: after the first heating is completed, the billet after being discharged from the furnace during first heating is subjected to second heating; the temperature of the soaking section is 1140~1170° C., and an in-furnace time is ≥200 min. In this way, through the second heating and by controlling the temperature of the soaking section, the energy consumption is reduced, the oxide skin and the oxidation burning loss are avoided, the alloy composition in the billet is further fully solubilized and homogenized, and the segregation is improved, which lays a foundation for obtaining an equiaxed grain structure and refining the recrystallized grain in the subsequent rolling.

In the second heating, preferably, the billet is subjected to three-stage heating. The input temperature is ≥700° C. The temperature of the preheating section is 950~1000° C. The temperature of the heating section is 1100~1150° C. In this way, by entering the furnace at high temperature, the preheating time and heating time in the second heating process are reduced, and energy saving and consumption reduction are realized. Certainly, in the implementation of the modification, the second heating can also be implemented by directly putting the billet into the soaking section at an input temperature of ≥700° C. (that is, there is no preheating section or heating section in the second heating).

Further, the first heating is carried out in a first heating furnace, and the second heating is carried out in a second heating furnace. That is, the first heating and the second heating are not carried out in the same heating furnace, so that it is convenient to achieve rapid production and simplify the process operation.

(2) Rolling Process

The billet discharged from the furnace in the heating process is rolled into a steel plate. The initial rolling temperature is 1060~1140° C., and the final rolling temperature is 980~1050° C. That is, after the heating process is completed, the billet is rolled into a steel plate by a rolling mill.

In this way, through the control over the initial rolling temperature and the final rolling temperature, the rolling process realizes the rolling technology in a recrystallization zone, the entire rolling is carried out in the recrystallization zone, finally the equiaxed grain is obtained to avoid the strip structure, the central segregation is reduced, the strip structure is eliminated, and the structure optimization of the steel plate is realized. Meanwhile, it can ensure that the load of the rolling mill is small during the rolling process, which, on the one hand, reduces the damage to the rolling mill, and on the other hand, improves the rolling efficiency and rhythm.

In the rolling process, the billet can be rolled into a steel plate with a thickness of ≥80 mm. That is, the production method provided by the present implementation is suitable for the preparation of a large-thickness plastic mold steel plate with a thickness of ≥80 mm. For the preparation of a large-thickness plastic mold steel plate, it has more significant advantages than the prior art. Preferably, in the present implementation, in the rolling process, the billet may be rolled into a steel plate with a thickness of 100~165 mm, so that the thickness of the obtained steel plate is 100~165 mm.

(3) Cooling After Rolling Process

The steel plate obtained through final rolling is moved to the cooling bed and air cooled to 200° C. or lower.

In the present implementation, the cooling after rolling process can be specifically as follows: the steel plate is naturally air cooled on a cooling bed, that is, without any intervention, until 200° C. or lower. Certainly, the specific implementation of the cooling after rolling process is not limited to this, for example, the specific implementation is carried out in the second implementation described below.

The final cooling temperature (that is, the end temperature) of the cooling after rolling process is 200° C. or below. Specifically, it can be room temperature, and then the subsequent normalizing process is carried out. That is, the input temperature of the steel plate in the normalizing process is room temperature. Alternatively, it can be preferably 100~200° C., and then the subsequent normalizing process is carried out. That is, the input temperature of the steel plate in the normalizing process is ≥100° C. Thus, the temperature normalizing can reduce the time of the steel plate in the normalizing process and reduce energy consumption.

In the present implementation, the cooling after rolling process can be specifically as follows: the steel plate is naturally air cooled on the cooling bed to 200° C. or lower, that is, without any intervention. Certainly, the specific implementation of the cooling after rolling process is not limited to this, for example, the specific implementation is carried out in the third implementation described below.

(4) Normalizing Process

The steel plate cooled in the cooling after rolling process is normalized, and the normalizing temperature $T_N$ is $A_{c3}$+60° C.≤$T_N$≤$A_{c3}$+90° C.

$A_{c3}$ is the temperature at which ferrite is all converted to austenite when heated, which can be specifically calculated by the mass percentage content of [C], [Ni], [Si], [V], and [Mo] in the chemical composition C, Ni, Si, V, and Mo of the billet, for example, in the present implementation, $A_{c3}=910-203\sqrt{[C]}-15.2\,[Si]+44.7\,[Si]+104\,[V]+31.5\,[Mo]$.

In the present implementation, through the normalizing process, especially through the control over normalizing temperature, in combination with the control over the above final rolling temperature, the structure uniformity and mechanical properties of the steel plate can be improved, and the structure and mechanical properties of the steel plate can be optimized.

Preferably, as described above, in the normalizing process, the input temperature is ≥100° C., which can reduce the time of the steel plate in the normalizing process and reduce energy consumption.

(5) Cooling After Normalizing Process

The steel plate produced by the normalizing process is moved to the cooling bed to be air cooled to $T_F$. $B_f$−50° C.≤$T_F$≤$B_f$−20° C., specifically and preferably, $T_F$=$B_f$−30° C. $B_f$ is the temperature at the end of the bainitic transformation in cooling, which can also be specially obtained from the supercooled austenite continuous cooling transformation curve (i.e. CCT curve), or can also be calculated based on the content of elements of the chemical composition of the steel plate.

In this way, by air cooling the steel plate to $T_F$ (that is, 20~50° C. below the end temperature of bainitic transformation $B_f$), the steel plate has completely undergone bainitic transformation from the surface to the core after the cooling after normalizing process, and surface microcracks can be avoided, so as to facilitate the further optimization of structure uniformity.

In the present implementation, the cooling after normalizing process can be specially as follows: the steel plate is naturally air cooled on the cooling bed to $T_F$, that is, without any intervention. Certainly, the specific implementation of the cooling after normalizing process is not limited to this, for example, the specific implementation is carried out in the second implementation described below.

(6) Cross-Stacking Self-Tempering Process

Immediately following the above cooling after normalizing process, that is, when the steel plate is cooled to $T_f$ by the cooling after normalizing process, the steel plate (referring to the steel plate provided/prepared by the present invention) and a ferritic pearlitic steel plate with a temperature of 450~550° C. are cross-stacked. The steel plate is self-tempered during the stacking until the temperature of the steel plate is reduced to $T_M$ again. After that, unstacking and natural air cooling to room temperature are carried out.

$B_f$−50° C.≤$T_M$≤$B_f$−20° C. The specific value of $T_M$ can be the same as or different from that of the above $T_F$, and the preferred value can be specifically and preferably $T_M$=$B_f$−30° C. Further, the cross stacking is that bottom and top layers are ferritic pearlitic steel plates, and steel plates and ferritic pearlitic steel plates are alternately stacked layer by layer. In this way, the upper surface of each steel plate is covered by its upper ferritic pearlitic steel plate, and the lower surface is covered by its lower ferritic pearlitic steel plate.

In this way, the steel plate with a temperature of $T_F$ and a ferritic pearlitic steel plate with a temperature higher than $T_F$ are cross-stacked, and are unstacked when the temperature of the steel plate is reduced to $T_M$ again. That is, the unstacking temperature is $T_M$ (20~50° C. below the end temperature of bainitic transformation $B_f$). Therefore, during the stacking period, the bainite structure of the steel plate undergoes a stable tempering transformation, achieving MA decomposition in the bainite structure, and carbide precipitation in the bainite ferrite. Then, the steel plate obtained in the present implementation is uniform in structure and property. Moreover, the stacking time is about 18~24 h, and it can ensure high production efficiency.

During the cross-stacking period, the temperature can be measured on a side of the steel plate, and the temperature measurement result can be used as the temperature of the steel plate. Then, whether the unstacking temperature $T_M$ has been reached is further determined. Certainly, the temperature of the upper surface of the upper steel plate can also be measured by lifting the top ferritic pearlitic steel plate, and the temperature measurement result can be used as the temperature of the steel plate. Then, whether the unstacking temperature has been reached is further determined.

Preferably, the length $L_2$, the width $W_2$, and the thickness $H_2$ of the steel plate and the length $L_1$, the width $W_1$, and the thickness $H_1$ of the ferritic pearlitic steel plate meet: $L_1$≥$L_2$+500 mm, $W_1$≥$W_2$+300 mm, and $H_1$≥$H_2$. In this way, the size of the ferritic pearlitic steel plate is larger than the size of the steel plate, so that the edge of the steel plate can also be effectively stacked and tempered, further ensuring the uniformity of the structure and property.

In summary, compared with the prior art, the present implementation has the beneficial effects:

On the one hand, through the process of heating, controlled rolling and cross-stacking self-tempering, the structure uniformity is significantly improved under a simple process route, and the difference in Rockwell hardness between the core and surface of the steel plate is within 1.6 HRC. The whole production process has a simple process flow; a short production cycle, high efficiency and low cost.

On the other hand, through the optimization design of the chemical composition, especially the interaction of C, Si, Mn, Cr, Ni and Mo alloying elements, in combination with the improvement of the production method, the bainitic transformation can occur in a large range of cooling speeds, and the structure uniformity of the steel plate is improved under the loose process and larger process window. The advantages are more obvious for large thick plates, especially for large thick plates with a thickness of ≥80 mm. Nb, V, Ti and other precipitated elements and high hardenability element B in the traditional technology are eliminated, saving alloy costs and solving crack defects caused by these elements.

Second Implementation

The present implementation also provides a plastic mold steel plate and a method for producing the same. As a further optimization of the above first implementation, the difference between the present implementation and the above first implementation mainly lies in the cooling after normalizing process. Only this difference is described below; and the remaining same parts will not be repeated.

First, in the cooling after normalizing process of the above first implementation, the steel plate is naturally air cooled on the cooling bed to $T_F$. Unlike this, in the present implementation, the cooling after normalizing process is as follows:

First, the normalized steel plate is moved to the cooling bed for natural air cooling. That is, no intervention is carried out until the upper surface temperature of the steel plate is reduced to $T_A$. $B_s$+15° C.≤$T_A$≤$B_s$+35° C., specifically and preferably, $T_A$=$B_s$+30° C. $B_s$ is the temperature at the beginning of the bainitic transformation in cooling, which can be obtained from the supercooled austenite continuous cooling transformation curve (i.e. CCT curve), or can also be calculated based on the content of elements of the chemical composition of the steel plate.

Then, that is, after the upper surface temperature of the steel plate is reduced to $T_A$, the fan is turned on, and the air under the steel plate is disturbed through the fan to control the difference between the upper surface temperature and the lower surface temperature of the steel plate ≤5° C. until the upper surface temperature of the steel plate is reduced to $T_F$.

That is, in the cooling after normalizing process of the present implementation, when the upper surface temperature of the steel plate is between $T_A$ and $T_F$, the air cooling method with fan intervention is used for cooling. In this way, in the entire phase transformation interval, the air under the steel plate is disturbed by the fan, so that the upper surface temperature and the lower surface temperature of the steel plate are basically the same, and the difference between the upper surface temperature and the lower surface temperature is always maintained within 5° C., so that the cooling speed, phase transformation start time, phase transformation end time and phase transformation process of the upper and lower surfaces of the steel plate are consistent, so as to avoid the micro-deformation of the steel plate during the phase transformation process and ensure that the unevenness of the final steel plate is small. In addition, the fan is adopted for disturbing air for temperature control, compared with the existing straightening and stacking-in-a-pit method, equipment costs can be reduced, the production efficiency can be improved. In addition, surface cracks of steel plates are avoided, lower energy costs and loose process conditions are ensured, and the production difficulty is reduced.

Further, the cooling bed is provided with a plurality of fans located under the steel plate and of which the air volume is adjustable. In this way, in the cooling after normalizing process, the number of fans turned on and the air volume of the fans can be adjusted according to the difference between the upper surface temperature and the lower surface temperature of the steel plate, so as to ensure that the difference between the upper surface temperature and the lower surface temperature of the steel plate is always maintained within 5° C. in the entire phase transformation interval.

For example, optionally, when the difference between the upper surface temperature and the lower surface temperature is >30° C., 10 fans are turned on, and the air volume of the fans is 80,000~100,000 $m^3$/h. When the difference between the upper surface temperature and the lower surface temperature is >15 and ≤30° C., 7 fans are turned on, and the air volume of the fans is 70,000~90,000 $m^3$/h. When the difference between the upper surface temperature and the lower surface temperature is >5 and ≤15° C., 3 fans are turned on, and the air volume of the fans is 70,000~90,000 $m^3$/h. When the difference between the upper surface temperature and the lower surface temperature is ≤5° C., no fan needs to be turned on. Certainly, this is only an example, and it can actually be implemented in other ways, basically ensuring that as the difference between the upper surface temperature and the lower surface temperature increases, the overall air volume of the fans is controlled to increase. Certainly, the specific parameter value of the air volume of the fans and the step change of the difference between the upper surface temperature and the lower surface temperature are not limited to this.

Further, the blowing direction of the fans is parallel to the lower surface of the steel plate or diagonally down away from the lower surface of the steel plate, so that the fans will not blow directly towards the lower surface of the steel plate, but only accelerate the air flow under the steel plate to ensure that the temperature of the lower surface of the steel plate is uniform and not locally low, further optimizing the plate shape and avoiding surface cracks.

Thus, compared with the prior art, in addition to the beneficial effects of the above first implementation, the present implementation can also improve the plate shape by simple process flow and low cost. The obtained plastic mold steel plate is detected in accordance with the GB/T 709-2019 standard, its unevenness is ≤4 mm/2 m, or even ≤3 mm/2 m, and the plate shape quality reaches or even exceeds that of a plastic mold steel plate in the prior art.

Third Implementation

The present implementation also provides a plastic mold steel plate and a method for producing the same. As a further optimization of the above first implementation, or the above second implementation, the difference between the present implementation and the above first implementation, or the above second implementation mainly lies in the cooling after rolling process. Only this difference is described below, and the remaining same parts will not be repeated.

First, in the cooling after rolling process of the above first implementation and the above second implementation, the steel plate is naturally air cooled on the cooling bed to 200° C. or lower. Unlike this, the cooling after rolling process of the present implementation is similar to the cooling after normalizing process of the second implementation, and is set as follows:

First, the final rolled steel plate is moved to the cooling bed for natural air cooling until the upper surface temperature of the steel plate is reduced to $T_A$.

Then, that is, after the upper surface temperature of the steel plate is reduced to $T_A$, the fan is turned on, and the air under the steel plate is disturbed through the fan to control the difference between the upper surface temperature and the lower surface temperature of the steel plate ≤5° C. until the upper surface temperature of the steel plate is reduced to $T_F$.

Subsequently, the fan remains off (that is, the airflow is no longer disturbed through the fan), and the steel plate is naturally air cooled from the upper surface temperature $T_F$ to 200° C. or lower.

That is, in the cooling after rolling process of the present implementation, as in the cooling after normalizing process of the above second implementation, when the upper surface temperature of the steel plate is between $T_A$ and $T_F$, the air cooling method with fan intervention is used for cooling. In this way, in the entire phase transformation interval, the upper surface temperature and the lower surface temperature of the steel plate are basically the same, avoiding micro-deformation of the steel plate and ensuring that the unevenness of the steel plate is small.

For the remaining fan regulation and wind direction setting, reference is made to the cooling after normalizing process of the second implementation, and they will not be repeated.

In this way, compared with the prior art, in addition to the beneficial effects of the above first implementation, the present implementation improves the plate shape by simple process flow and low cost. The obtained plastic mold steel plate is detected in accordance with the GB/T 709-2019 standard, its unevenness is ≤4 mm/2 m, or even ≤3 mm/2 m, and the plate shape quality reaches or even exceeds that of a plastic mold steel plate in the prior art.

Several embodiments of the present invention are provided below to further illustrate the technical solution of the present invention.

Firstly, steel plates provided in Embodiment 1~7 were prepared by a continuous casting billet cast by the same furnace steel. The chemical composition of the continuous casting billet included: C: 0.35%, Si: 0.15%, Mn: 0.81%, P≤0.014%, S≤0.004%, Cr: 1.60%, Ni: 0.80%, Mo: 0.18%, and the balance of Fe and unavoidable impurities, as calculated as the percentage by mass, the Cr/Mn ratio being 1.98, the Cr/(Mn+Ni) ratio being 0.99, and Mn+Cr+Ni+Mo accounting for 3.39%.

Thus, the chemical composition of the steel plates in the embodiments was also as above. Based on the mass percentage content of [C], [Ni], [Si], [V], and [Mo] in the chemical composition C, Ni, Si, V, and Mo of the billet, the formula $A_{c3}=910-203\sqrt{[C]}-15.2[Ni]+44.7[Si]+104\ [V]+31.5[Mo]$ was used to calculate $A_{c3}$ as 790° C. The CCT curve yielded BS=487° C. and $B_f$=346° C.

The steel plates of Embodiments 1~7 were all prepared through the heating process, the rolling process, the cooling after rolling process, the normalizing process, the cooling after normalizing process, and the cross-stacking self-tempering process, and the details were as follows.

(1) Heating Process

The billet used in each of Embodiment 1~7 was sent to the first heating furnace for three-stage heating. The temperature of the preheating section was 850~950° C. The residence time of the preheating section was ≥60 min. The temperature of the heating section was 1100~1220° C. The temperature of the soaking section was 1210~1250° C. The in-furnace time was ≥240 min.

After discharged from the first heating furnace, the billet was subjected to three-stage heating in the second heating furnace. The input temperature was ≥700° C. The temperature of the preheating section was 950~1000° C. The temperature of the heating section was 1100~1150° C. The temperature of the soaking section was 1140~1170° C. The in-furnace time was ≥200 min.

(2) Rolling Process

The billet used in each of Embodiment 1~7 was rolled into a steel plate after being discharged from the second heating furnace. The initial rolling temperature was 1060~1140° C. The final rolling temperature was 980~1050° C. The thickness of the steel plate of each of Embodiment 1~7 was shown in Table 1.

(3) Cooling After Rolling Process

Immediately after the rolling process, the steel plate of each of Embodiment 1~5 was moved to the cooling bed, and naturally air cooled to 100° C.~200° C.

However, the steel plate of each of Embodiment 6~7 was moved to the cooling bed. First, natural air cooling was carried out until the upper surface temperature of the steel plate was reduced to 517° C. At this time, it was found in tests that the lower surface temperature of the steel plate of each of Embodiments 6 and 7 was 541° C. and 549° C. The temperature difference between the upper surface temperature and the lower surface temperature of the steel plate of each of Embodiments 6 and 7 was 24° C. and 32° C. In Embodiments 6 and 7, 7 and 10 fans were turned on respectively and disturbed the air under the steel plates through the fans to control the difference between the upper surface temperature and the lower surface temperature of the steel plate to be reduced to within 5° C. Then the number of fans turned on and the air volume of the fans were adjusted according to the upper surface temperature and the lower surface temperature of the steel plates. Thus, the difference between the upper surface temperature and the lower surface temperature of the steel plates was maintained within 5° C., until the upper surface temperature of the steel plates is reduced to 296~326° C. Then, natural air cooling was carried out to 100° C.~200° C.

(4) Normalizing Process

Immediately after the cooling after rolling process, the steel plates of Embodiments 1~7 were normalized respectively. The input temperature was ≥100° C. The normalizing temperature was 870° C.

(5) Cooling After Normalizing Process

Immediately after the normalizing process, the steel plates of Embodiments 1~4, and 6 were moved to the cooling bed, and naturally air cooled to 296~326° C. to end the process.

The steel plates of Embodiments 5 and 7 were moved to the cooling bed. First, natural air cooling was carried out until the upper surface temperature of the steel plate was reduced to 517° C. At this time, it was found in tests that the lower surface temperature of the steel plate of each of Embodiments 5 and 7 was 537° C. and 546° C. The temperature difference between the upper surface temperature and the lower surface temperature of the steel plate of each of Embodiments 5 and 7 was 20° C. and 29° C. In Embodiments 5 and 7, 7 fans and 7 fans were turned on respectively and disturbed the air under the steel plates through the fans to control the difference between the upper surface temperature and the lower surface temperature of the steel plates to be reduced to within 5° C. Then the number of fans turned on and the air volume of the fans were adjusted according to the upper surface temperature and the lower surface temperature of the steel plates. Thus, the difference between the upper surface temperature and the lower surface temperature of the steel plate was maintained within 5° C., until the upper surface temperature of the steel plates was reduced to 296~326° C. The process was ended.

(6) Cross-Stacking Self-Tempering Process

Immediately after the cooling after normalizing process, each steel plate of Embodiments 1~7 and ferritic pearlitic steel plates with a temperature of 450~550° C. were cross-stacked according to the manner that bottom and top layers were ferritic pearlitic steel plates, and the steel plates and ferritic pearlitic steel plates were alternately cross-stacked layer by layer. The steel plates were tempered and heated up during stacking until the temperature of the steel plates was reduced to 296° C. again. The plates were unstacked. Then natural air cooling was carried out to room temperature.

The length $L_2$, the width $W_2$, and the thickness $H_2$ of the steel plates and the length $L_1$, the width $W_1$, and the thickness $H_1$ of the ferritic pearlitic steel plates met: $L_1 \geq L_2+500$ mm, $W_1 \geq W_2+300$ mm, and $H_1 \geq H_2$.

Figure 1B:
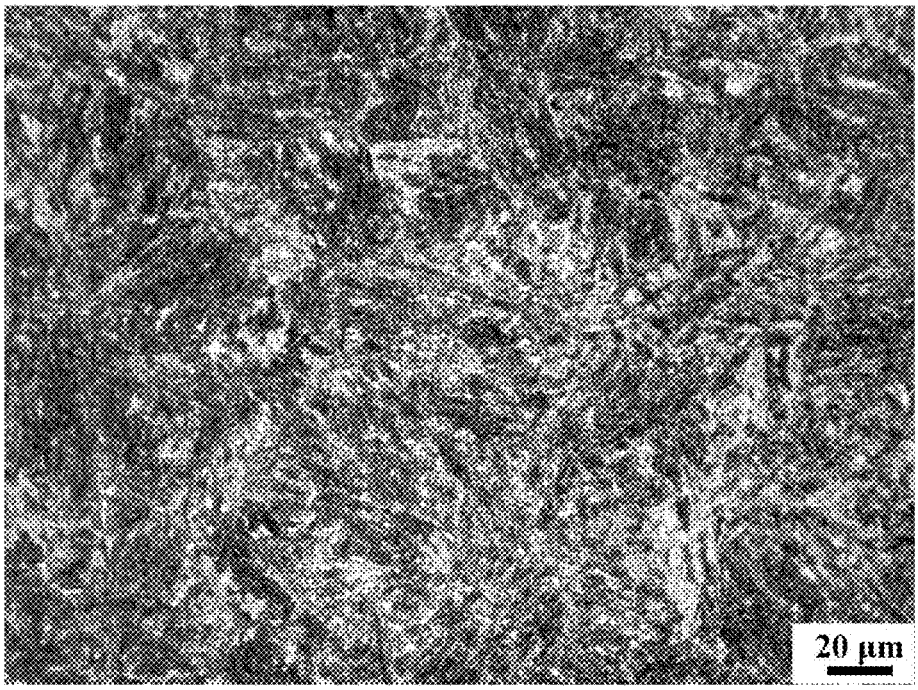
Figure 2A:
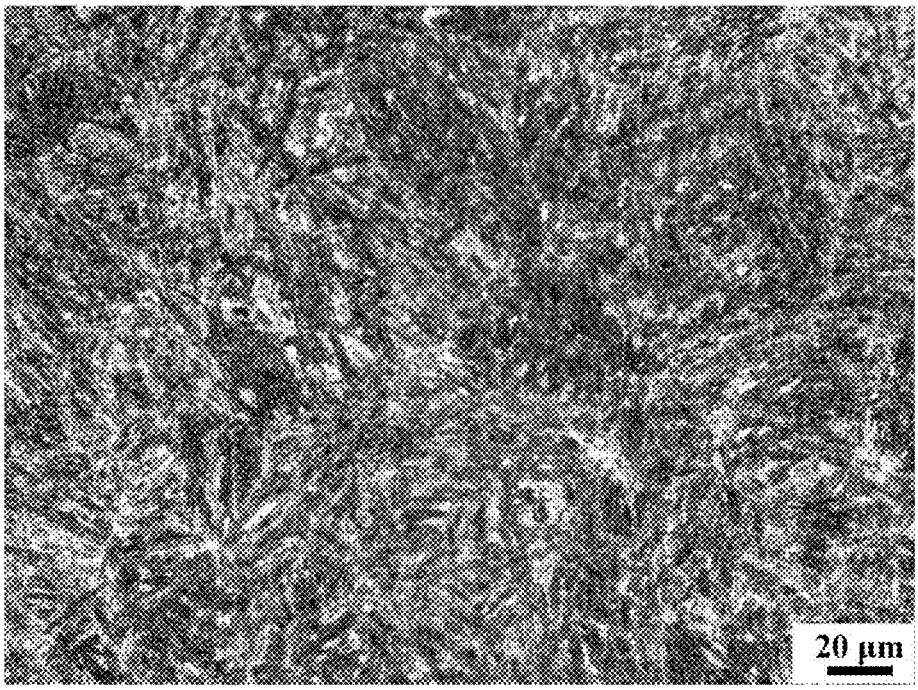
FIGS. 2*a* and 2*b* are a metallographic microstructure image of a cross section of a steel plate in Embodiment 2 of the present invention, where
Figure 2B:
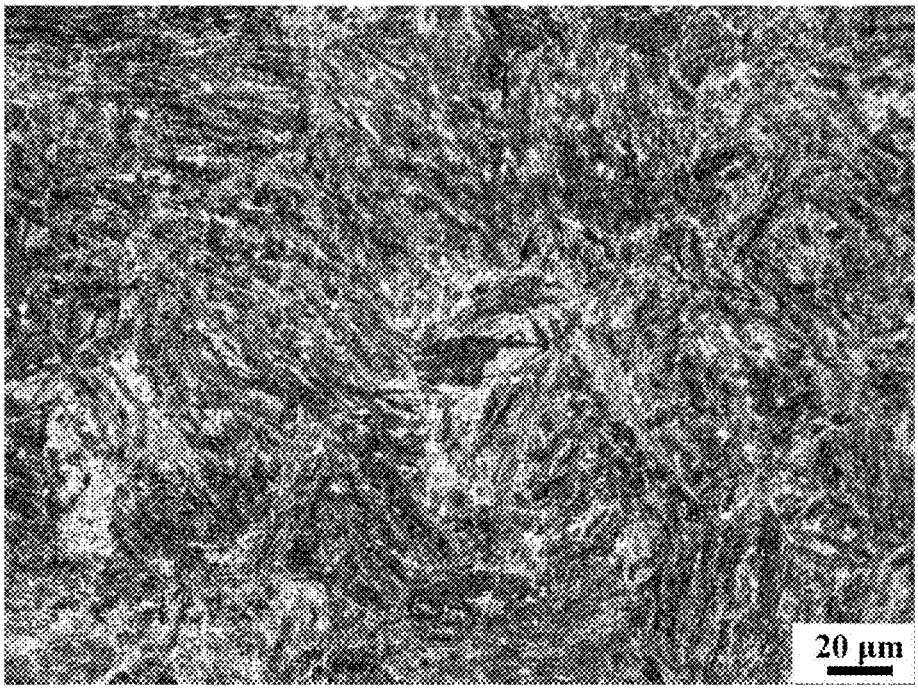
Figure 3A:
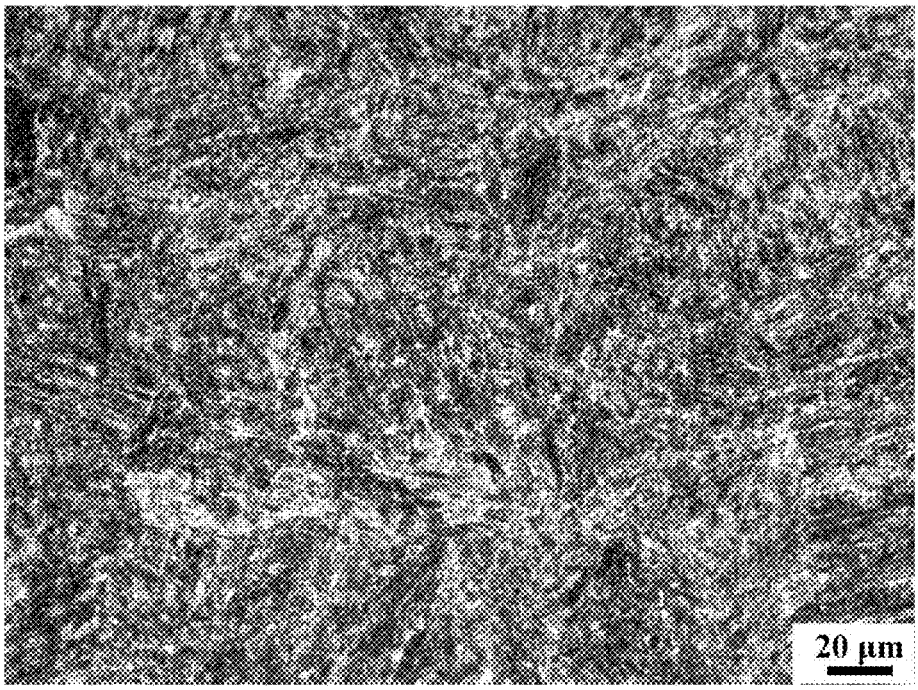
FIGS. 3*a* and 3*b* are a metallographic microstructure image of a cross section of the steel plate in Embodiment 3 of the present invention, where
Figure 3B:
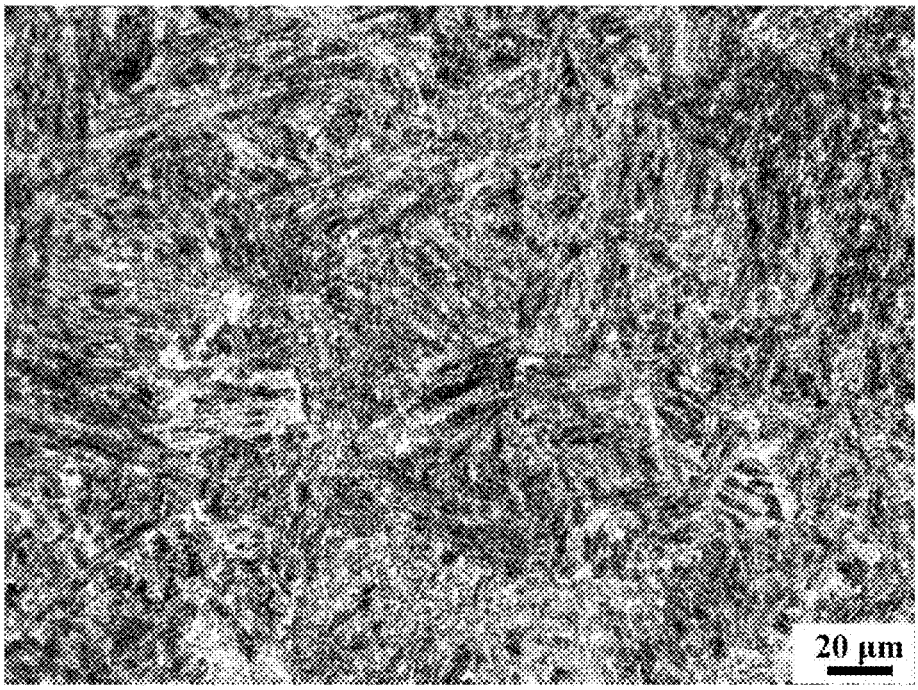
Figure 4A:
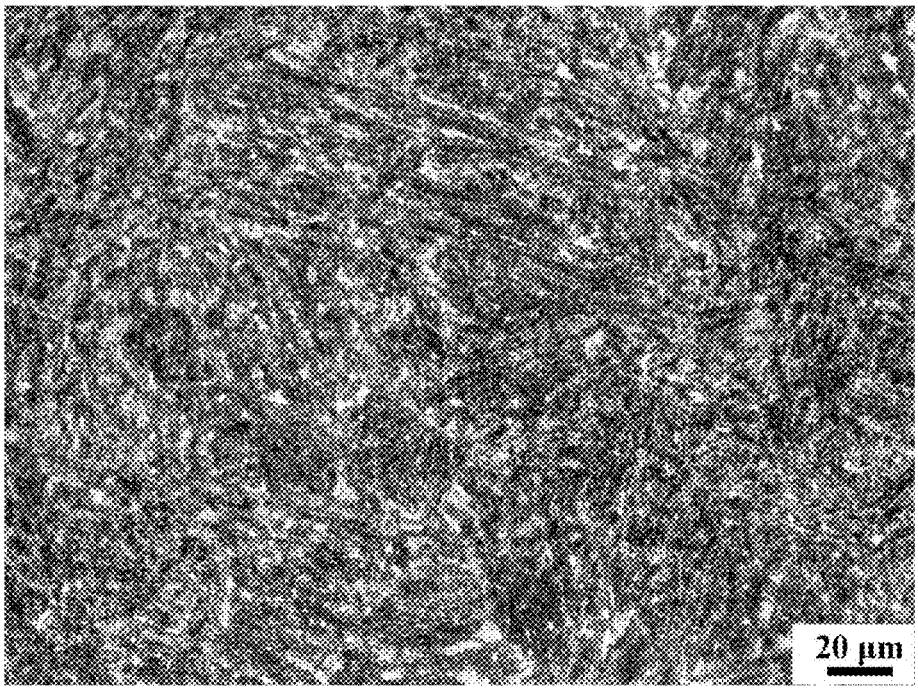
FIGS. 4*a* and 4*b* are a metallographic microstructure image of a cross section of a steel plate in Embodiment 4 of the present invention, where
Figure 4B:
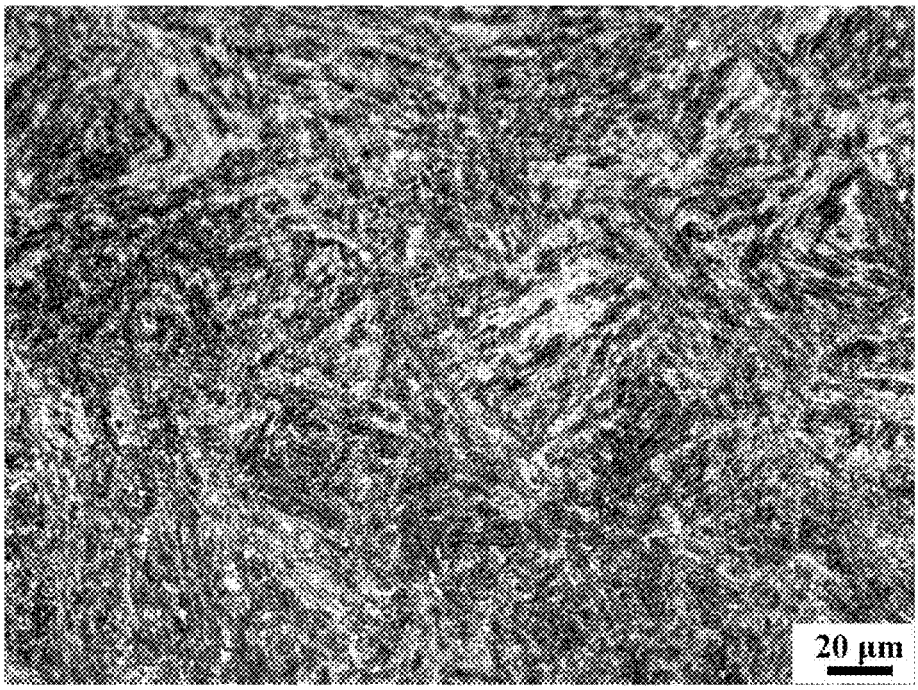

For each steel plate of Embodiments 1~7, sampling and testing were carried out separately. It can be seen that the structure is excellent and the structure uniformity is good. Metallographic structure images of Embodiments 1~4 can be seen in FIG. 1*a*~FIG. 4*b* respectively. In addition, the thickness, mechanical properties, structure properties, and unevenness of the steel plate obtained in each embodiment (in accordance with the GB/T 709-2019 standard) are shown in Table 1.

TABLE 1

| | Plate thickness/ mm | Yield strength/ MPa | Tensile strength/ MPa | V-type Charpy impact/J | Rockwell hardness/HRC Core | Rockwell hardness/HRC Surface | Unevenness/ mm/2 m |
|---|---|---|---|---|---|---|---|
| Embodiment 1 | 105 | 748 | 1070 | 16.7 | 32.4 | 33.7 | 4 |
| Embodiment 2 | 120 | 759 | 1084 | 16.5 | 32.2 | 33.5 | 3 |
| Embodiment 3 | 140 | 755 | 1067 | 16.1 | 31.4 | 32.8 | 3 |
| Embodiment 4 | 165 | 743 | 1059 | 16.4 | 31.1 | 32.7 | 2 |
| Embodiment 5 | 120 | 761 | 1085 | 16.7 | 32.3 | 33.6 | 2 |
| Embodiment 6 | 140 | 752 | 1061 | 16.3 | 31.5 | 32.8 | 2 |
| Embodiment 7 | 165 | 755 | 1063 | 16.5 | 31.3 | 32.8 | 1 |

In combination with various embodiments, it can be seen that the steel plate of the present invention has excellent structure uniformity. The difference in Rockwell hardness between the surface layer and the core is ≤1.6 HRC. Moreover, the mechanical property and structural property are good. The yield strength is ≥700 MPa. The tensile strength is ≥1050 MPa. The V-type Charpy impact is ≥15 J. The Rockwell hardness is 31~34 HRC. Through Embodiments 5~7, it can also be seen that through the temperature control of the phase transformation zone in the cooling after rolling process and/or the cooling after normalizing process, plate shape control can also be realized, and the unevenness is ≤2 mm/2 m.

It should be appreciated that although the present description is described in accordance with implementations, each implementation does not necessarily include only one independent technical solution. The presentation manner of the description is merely for clarity, those skilled in the art should regard the description as a whole, and the technical solutions in each implementation can also be appropriately combined to form other implementations comprehensible by those skilled in the art.

The detailed description listed above is only a specific description of the feasible implementations of the present invention, they are not intended to limit the scope of protection of the present invention, and any equivalent implementations or changes without departing from the spirit of the present invention shall be included in the scope of protection of the present invention.

What is claimed is:

1. A method for producing a plastic mold steel plate, comprising the following processes, first heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

second heating: reheating the billet discharged from the furnace in the first heating process, a temperature of a soaking section being 1140~1170° C., and an in-furnace time being ≥200 min;

rolling: rolling the billet discharged from the furnace in the second heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}$+60° C.≤$T_N$≤$A_{c3}$+90° C.;

cooling after normalizing: moving the steel plate produced by the normalizing process to the cooling bed for air cooling to $T_F$, $B_f$−50° C.≤$T_F$≤$B_f$−20° C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $B_f$−50° C.≤$T_M$≤$B_f$−20° C.; after that, unstacking and naturally air cooling the steel plate to room temperature, wherein the cross stacking is that bottom and top layers are ferritic pearlitic steel plates, and steel plates and ferritic pearlitic steel plates are alternately stacked layer by layer.

2. The method for producing a plastic mold steel plate according to claim 1, wherein a length $L_2$, a width $W_2$, and a thickness $H_2$ of the steel plate and a length $L_1$, a width $W_1$, and a thickness $H_1$ of the ferritic pearlitic steel plate meet: $L_1 \geq L_2$+500 mm, $W_1 \geq W_2$+300 mm, and $H_1 \geq H_2$.

3. The method for producing a plastic mold steel plate according to claim 1, wherein in the second heating process, the billet is subjected to the three-stage heating, an input temperature is ≥700° C., the temperature of the preheating section is 950~1000° C., and the temperature of the heating section is 1100~1150° C.

4. The method for producing a plastic mold steel plate according to claim 1, wherein in the rolling process, the billet is rolled into a steel plate with a thickness of ≥80 mm.

5. The method for producing a plastic mold steel plate according to claim 1, wherein any one or both of the cooling after rolling process and the cooling after normalizing process comprises/comprise:

first, moving the steel plate to the cooling bed for naturally air cooling the steel plate until an upper surface temperature of the steel plate is reduced to $T_A$, $B_s$+15° C.≤$T_A$≤$B_s$+35° C.;

then, turning a fan on and disturbing air under the steel plate through the fan to control a difference between the upper surface temperature and a lower surface temperature of the steel plate ≤5° C. until the upper surface temperature of the steel plate is reduced to $T_F$, wherein a blowing direction of the fan is parallel to a lower surface of the steel plate or diagonally down away from the lower surface of the steel plate.

6. The method for producing a plastic mold steel plate according to claim 5, wherein unevenness of the obtained steel plate is ≤4 mm/2 m.

7. The method for producing a plastic mold steel plate according to claim 1, wherein a final cooling temperature is 100~200° C. in the cooling after rolling process; and an input temperature in the normalizing process is ≥100° C.

8. The method for producing a plastic mold steel plate according to claim 1, wherein the chemical composition of the billet used comprises: C 0.33~0.38%, Si 0.11~0.19%, Mn 0.70~0.90%, P≤0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0%~3.8%.

9. The method for producing a plastic mold steel plate according to claim 1, wherein the obtained steel plate has a yield strength of ≥700 MPa, a tensile strength of ≥1050 MPa, a V-type Charpy impact of ≥15 J, and a Rockwell hardness of 31~34 HRC, and a difference in Rockwell hardness between a surface layer and a core is ≤1.6 HRC.

10. A method for producing a plastic mold steel plate, comprising the following processes, heating: sending a billet to a heating furnace for three-stage heating, a temperature of a preheating section being 850~950° C., a residence time of the preheating section being ≥60 min, a temperature of a heating section being 1100~1220° C., a temperature of a soaking section being 1210~1250° C., and an in-furnace time being ≥240 min;

rolling: rolling the billet discharged from the furnace in the heating process into a steel plate, an initial rolling temperature being 1060~1140° C., and a final rolling temperature being 980~1050° C.;

cooling after rolling: moving the steel plate obtained by the final rolling to a cooling bed and cooling the steel plate to 200° C. or lower;

normalizing: normalizing the steel plate cooled in the cooling after rolling process, and a normalizing temperature $T_N$ being $A_{c3}$+60° C.≤$T_N$≤$A_{c3}$+90° C.;

cooling after normalizing: moving the steel plate produced by the normalizing process to the cooling bed for air cooling to $T_F$, $B_f$−50° C.≤$T_F$≤$B_f$−20° C.; and cross-stacking self-tempering: cross-stacking the steel plate and a ferritic pearlitic steel plate with a temperature of 450~550° C., and self-tempering the steel plate during the stacking period until the temperature of the steel plate is reduced to $T_M$ again, $B_f$−50° C.≤$T_M$≤$B_f$−20° C.; after that, unstacking and naturally air cooling the steel plate to room temperature, wherein the cross stacking is that bottom and top layers are ferritic pearlitic steel plates, and steel plates and ferritic pearlitic steel plates are alternately stacked layer by layer.

11. The method for producing a plastic mold steel plate according to claim 10, wherein a length $L_2$, a width $W_2$, and a thickness $H_2$ of the steel plate and a length $L_1$, a width $W_1$, and a thickness $H_1$ of the ferritic pearlitic steel plate meet: $L_1 \geq L_2$+500 mm, $W_1 \geq W_2$+300 mm, and $H_1 \geq H_2$.

12. The method for producing a plastic mold steel plate according to claim 10, wherein any one or both of the cooling after rolling process and the cooling after normalizing process comprises/comprise:

first, moving the steel plate to the cooling bed for naturally air cooling the steel plate until an upper surface temperature of the steel plate is reduced to $T_A$, $B_s$+15° C. ≤$T_A$≤$B_s$+35° C.;

then, turning a fan on and disturbing air under the steel plate through the fan to control a difference between the upper surface temperature and a lower surface temperature of the steel plate ≤5° C. until the upper surface temperature of the steel plate is reduced to $T_F$, wherein a blowing direction of the fan is parallel to a lower surface of the steel plate or diagonally down away from the lower surface of the steel plate.

13. The method for producing a plastic mold steel plate according to claim 10, wherein the chemical composition of the billet used comprises: C 0.33~0.38%, Si 0.11~0.19%, Mn 0.70~0.90%, P≤0.014%, S≤0.004%, Cr 1.40~1.80%, Ni 0.70~0.90%, Mo 0.16~0.24%, and the balance of Fe and unavoidable impurities, as calculated as the percentage by mass, a Cr/Mn ratio being 2±0.05, a Cr/(Mn+Ni) ratio being 1±0.05, Mn+Cr+Ni+Mo accounting for 3.0% ~3.8%.

14. The method for producing a plastic mold steel plate according to claim 10, wherein the obtained steel plate has a yield strength of ≥700 MPa, a tensile strength of ≥1050 MPa, a V-type Charpy impact of ≥15 J, and a Rockwell hardness of 31~34 HRC, and a difference in Rockwell hardness between a surface layer and a core is ≤1.6 HRC.

* * * * *